US011066944B2

(12) United States Patent
Urac et al.

(10) Patent No.: US 11,066,944 B2
(45) Date of Patent: Jul. 20, 2021

(54) COMPRESSOR SHROUD WITH SHROUD SEGMENTS

(71) Applicant: PRATT & WHITNEY CANADA CORP., Longueuil (CA)

(72) Inventors: Tibor Urac, Mississauga (CA); Barry Barnett, Unionville (CA)

(73) Assignee: PRATT & WHITNEY CANADA CORP, Longueuil (CA)

( * ) Notice: Subject to any disclaimer, the term of this patent is extended or adjusted under 35 U.S.C. 154(b) by 93 days.

(21) Appl. No.: 16/271,179

(22) Filed: Feb. 8, 2019

(65) Prior Publication Data

US 2020/0256205 A1 Aug. 13, 2020

(51) Int. Cl.
*F01D 9/04* (2006.01)

(52) U.S. Cl.
CPC ..... *F01D 9/042* (2013.01); *F05D 2230/60* (2013.01); *F05D 2240/12* (2013.01)

(58) Field of Classification Search
CPC ..... F01D 9/04; F01D 9/042; F01D 25/243; F01D 25/246; F05D 2230/60
See application file for complete search history.

(56) References Cited

U.S. PATENT DOCUMENTS 2,945,673 A 7/1960 Hockert et al.
4,940,386 A 7/1990 Feuvrier et al.
5,332,360 A * 7/1994 Correia ..... F01D 9/042 29/889.21
6,050,776 A * 4/2000 Akagi ..... F01D 5/22 415/138
6,425,736 B1 7/2002 McMahon et al.
6,910,854 B2 * 6/2005 Joslin ..... F01D 5/225 415/139
8,182,213 B2 * 5/2012 Cheung ..... F01D 9/044 415/200
8,240,985 B2 * 8/2012 Martin ..... F01D 11/005 415/1
8,454,303 B2 * 6/2013 Garcia-Crespo ..... F01D 9/042 415/137
9,079,245 B2 * 7/2015 Durocher ..... F01D 9/02
9,556,746 B2 * 1/2017 Paradis ..... F01D 5/142
9,611,747 B2 4/2017 Derclaye
10,280,797 B2 * 5/2019 Beljambe ..... B64D 27/26
10,337,340 B2 * 7/2019 Cortequisse ..... F01D 5/02
2007/0212215 A1 9/2007 Ferber et al.
(Continued)

*Primary Examiner* — Richard A Edgar
*Assistant Examiner* — Jackson N Gillenwaters
(74) *Attorney, Agent, or Firm* — Norton Rose Fulbright Canada LLP

(57) ABSTRACT

There is disclosed a shroud for a compressor stator, including: shroud segments extending circumferentially around an axis along portions of a circumference of the shroud. At least one of the shroud segments extending from a first lateral edge to a second lateral edge. The shroud segment has an inner face oriented toward the axis and an opposed outer face oriented away from the axis. At least one opening extends from the inner face to the outer face for receiving a vane of the compressor. A tab protrudes circumferentially from the second lateral edge and away from the first lateral edge. A slot extends circumferentially from the first lateral edge toward the second lateral edge. The tab is matingly received within a slot of an adjacent one of the shroud segments.

18 Claims, 3 Drawing Sheets

(56) References Cited

U.S. PATENT DOCUMENTS

| | | | | |
|---|---|---|---|---|
| 2012/0257963 | A1 | 10/2012 | Major et al. | |
| 2016/0376904 | A1 | 12/2016 | Schwarz et al. | |
| 2018/0016924 | A1* | 1/2018 | Gallier | F01D 9/042 |
| 2018/0080454 | A1* | 3/2018 | Baumann | F01D 9/044 |
| 2018/0363482 | A1 | 12/2018 | Sari et al. | |
| 2020/0063578 | A1* | 2/2020 | Notarnicola | F01D 25/246 |

* cited by examiner

COMPRESSOR SHROUD WITH SHROUD SEGMENTS

TECHNICAL FIELD

The application relates generally to gas turbine engines and, more particularly, to compressors of such engines.

BACKGROUND OF THE ART

The heavier a gas turbine engine is for a specific thrust, the more fuel it consumes. It is a constant design challenge to keep the weight of gas turbine engines as small as possible. Consequently, there is still room for improvement to make some components of a gas turbine engine lighter.

SUMMARY

In one aspect, there is provided a shroud for a compressor stator, comprising shroud segments circumferentially distributed around an axis of the shroud, at least one of the shroud segments extending from a first lateral edge to a second lateral edge, the at least one of the shroud segments having an inner face oriented toward the axis and an opposed outer face oriented away from the axis, at least one opening extending from the inner face to the outer face for receiving at least one vane of the compressor, a tab protruding circumferentially from the second lateral edge and away from the first lateral edge, and a slot extending circumferentially from the first lateral edge toward the second lateral edge, the tab matingly received within a slot of an adjacent one of the plurality of shroud segments.

In another aspect, there is provided a shroud segment for a shroud of a compressor stator having an axis, comprising: a body having a first lateral edge and a second lateral edge, the body extending circumferentially relative to the axis from the first lateral edge to the second lateral edge, an inner face oriented toward the axis and an opposed outer face oriented away from the axis, at least one opening extending from the inner face to the outer face for receiving at least one vane of the compressor, a tab protruding circumferentially from the second lateral edge and away from the first lateral edge, and a slot extending circumferentially from the first lateral edge toward the second lateral edge, the tab configured to be matingly received within a slot of a circumferentially adjacent shroud segment, the slot configured to receive a tab of another circumferentially adjacent shroud segment.

In yet another aspect, there is provided a method of assembling a shroud for a compressor, the shroud including a plurality of shroud segments, the method comprising: disposing each of the shroud segments circumferentially between two adjacent shroud segments relative to an axis of the shroud; inserting circumferentially extending tabs of the shroud segments in corresponding slots defined in adjacent shroud segments; and securing the shroud segments to each other.

DESCRIPTION OF THE DRAWINGS

Reference is now made to the accompanying figures in which.

DETAILED DESCRIPTION

Figure 1:
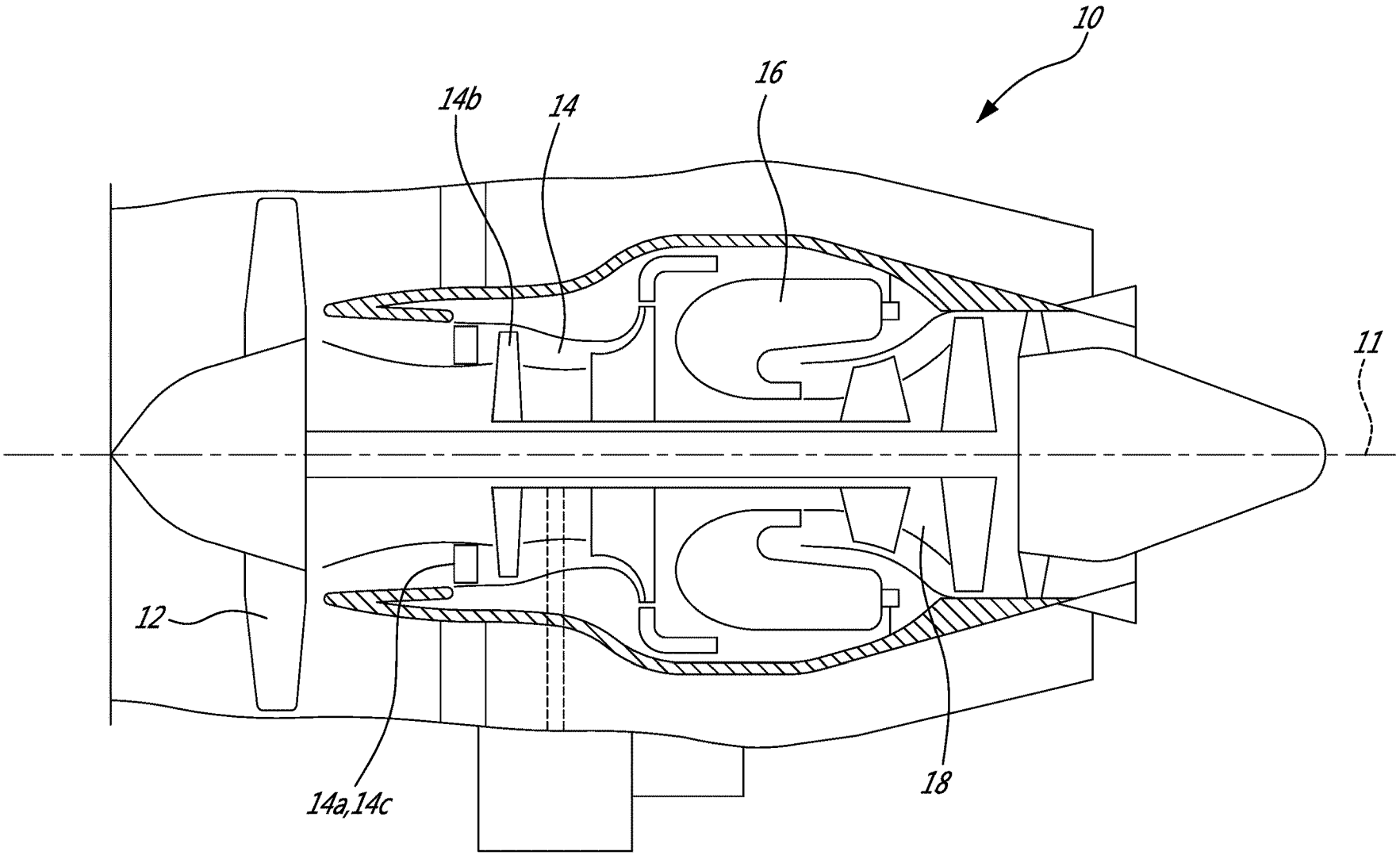
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are rotatable about an axis 11 of the gas turbine engine 10.

The compressor section 14 may include a plurality of stators 14*a* and rotors 14*b*, only one of which are shown in the low-pressure compressor shown in FIG. 1. In an embodiment, a compressor may include more than one stator and more than one rotor, they are disposed in alteration along the axis 11 of the engine 10. This may for example be the case for a low-pressure compressor.

Figure 2:
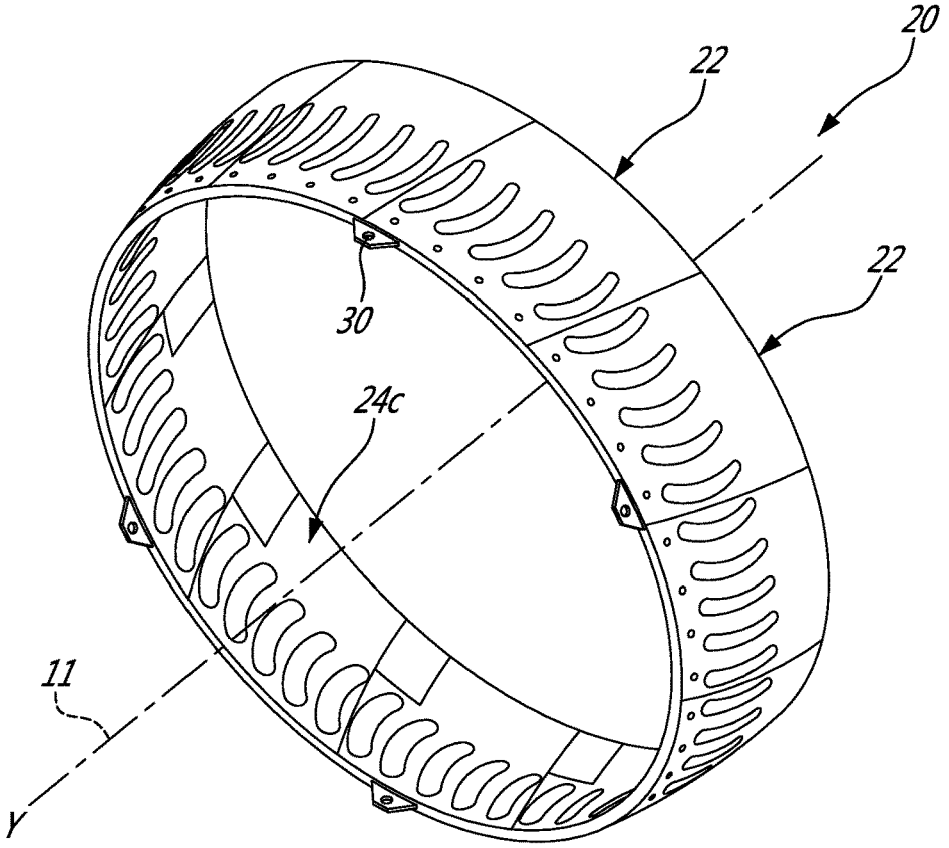
FIG. 2 is a schematic three-dimensional view of a shroud of a compressor of the gas turbine engine of FIG. 1 in accordance with one embodiment.
Figure 3:
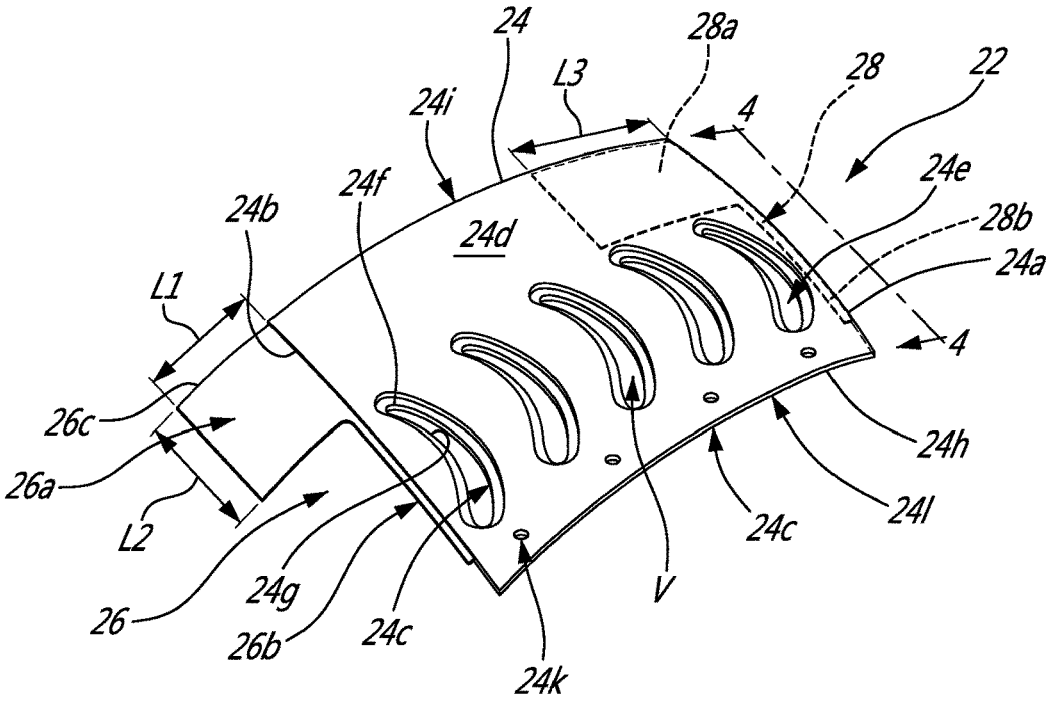
FIG. 3 is a schematic three-dimensional view of a segment of the shroud of FIG. 2.
Figure 4:
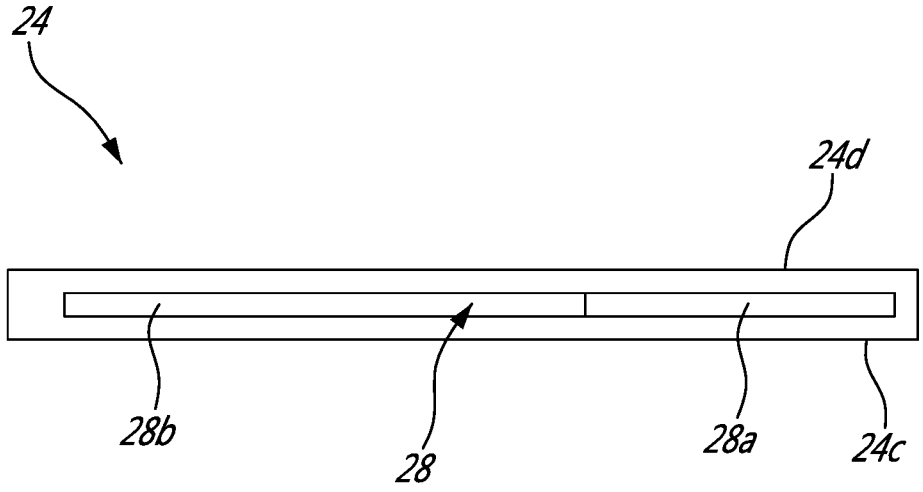
FIG. 4 is a view taken along line 4-4 on FIG. 3.

Referring now to FIGS. 2-4, each of the stators 14 may include a shroud 20 and vanes 14*c* (FIG. 1) secured to the shroud 20. The vanes 14*c* include platforms and airfoils protruding from the platforms. The platforms may be secured to the shroud 20.

Typically, a shroud is made of a single piece. For example, the single piece may be machined from a single block of metallic material. The shroud may also be made with a polymer material that might be lighter than a metallic material. In a particular embodiment, manufacturing the shroud with multiple shroud segments may allos cost saving compared to a shroud manufactured as a single piece. In a particular embodiment, single piece manufacturing using alternative processes such as Resin Transfer Molding or a manual lay-up may not be cost effective in manpower and/or tooling, among other things. Manufacturing processes for thermoplastic materials, such as compression molding, injection molding and stamp forming, require hard tooling. Such tooling is expensive and may be complex to manufacture for a full, single piece, shroud. Moreover, such a tooling may take a long time to develop. In a particular embodiment, tooling for a shroud segment may be simpler, less expensive, and/or faster to develop than tooling for a full, single piece, shroud thus making it feasible and attractive.

In the embodiment shown, the shroud 20 includes a plurality of shroud segments 22 circumferentially distributed around the axis 11. As shown, each of the shroud segments 22 forms a portion of a circumference of the shroud 20. The shroud segments 22 are secured to one another to create the shroud 20. In other words, each of the shroud segments 22 is secured to two adjacent ones of the shroud segments 22. More detail about how the shroud segments 22 are secured to each other are presented herein below.

One of the shroud segments 22 is described herein below with reference to FIG. 3. It is understood that, although the below description uses the singular form, it might be applied to each of the shroud segments 22 of the shroud 20. In an embodiment, all shroud segments 22 have the same configuration and/or are the same.

The shroud segment 22 includes a body 24 which is a plate like body (e.g., sheet, panel) in that its circumferential length (in the circumferential direction of the shroud 20) and axial length (in the axial direction of the shroud 20) are substantially greater than the thickness. The body 24 that extends circumferentially relative to the axis 11 from a first lateral edge 24*a* to a second lateral edge 24*b* opposite the first lateral edge 24*a*. The first and second lateral edges 24*a*, 24*b* face opposite directions. The body 24 includes an inner face 24*c* and an outer face 24*d* opposed to the inner face 24*c*. The inner face 24*c* faces toward the axis 11, i.e., it is radially inward, whereas the outer face 24*d* faces away from the axis 11, i.e., it is radially outward.

The body 24 may define at least one opening 24*e*, five in the embodiment shown, that are configured to receive the vanes 14*c* (FIG. 1) of the compressor stator 14*a*. The shroud segment 22 may include more or less than five openings. The opening 24*e* extends through the body 24, i.e., from the inner face 24*c* to the outer face 24*d*. In the embodiment shown, the opening 24*e* is circumferentially surrounded by an abutment surface 24*f* and by a peripheral surface 24*g*. The peripheral surface 24*g* extends from the outer surface 24*d* toward the inner surface 24*c*. The abutment surface 24*f* extends from the peripheral surface 24*g* to the opening 24*e*. The abutment surface 24*f* may be known as a shoulder. In other words, the opening 24*e* has a first section extending from the outer surface 24*d* to a mid-plane coincident with the abutment surface 24*f*, and located at any location between the inner and outer surfaces 24*c*, 24*d*, and a second section extending from the mid-plane to the inner surface 24*c*. It is understood that the mid-plane, corresponding to the intersection between the first and second sections, may be equidistant from both of the inner and outer surfaces 24*c*, 24*d*. The mid-plane may be closer to either one of the inner and outer surfaces 24*c*, 24*d*.

The first section is bound by the abutment and peripheral surfaces 24*f*, 24*g* and defines a volume V configured for receiving the platform of one of the vanes 14*c* (FIG. 1). The volume V may be sized correspondingly to accommodate the platform. In a particular embodiment, a grommet, which may be a potted or separate elastomeric grommet, may be disposed around the vane 14*c* for creating an interface between the vane 14*c* and the abutment surface 24*f*. In other words, the vane 14*c* may be inserted through the opening 24*e* until the platform (or the grommet) is in contact with the abutment surface 24*f*. The abutment surface 24*f* limits movements of the vane in a radial direction relative to the axis 11. Movements of the platform of the vane 14*c* within a plane parallel to the outer surface 24*d* is limited by the peripheral surface 24*g*, which might be in direct contact with the platform of the vane 14*c* or with the grommet.

The body 24 of the shroud segment 22 defines a forward edge 24*h* and a rearward edge 24*i* opposed to the forward edge 24*h*. The forward and rearward edges 24*h*, 24*i* extend from the first lateral edge 24*a* to the second lateral edge 24*b*. In the embodiment shown, the openings 24 may be closer to the forward edge 24*h* than from the rearward edge 24*i*. The reason for this is explained herein below. Herein, first and second lateral edges 24*a*, 24*b*, and the forward and rearward edges 24*h*, 24*i*, may be referred by faces as the body 24 has a thickness.

Still referring to FIG. 3, the shroud segment 22 includes a tab 26 that protrudes circumferentially relative to the axis 11 from the second lateral edge 24*b* and away from the first lateral edge 24*a*. The tab 26 is configured to be matingly received within a slot 28 defined by the body 24 and that extends circumferentially from the first lateral edge 24*a* toward the second lateral edge 24*b*. The tab 26 may include a first tab portion 26*a* only, or may also include a second tab portion 26*b*. In another embodiment, 26*a* and 26*b* are distinct or separate tabs, that are interconnected or not. In the embodiment shown, the second tab portion 26*b* extends from the first tab portion 26*a* and away from the rearward edge 24*i*. In the embodiment shown, the tab 26 and slot 28 are located between the inner and outer edges 24*c*, 24*d*. The tab 26 and slot 28 might be located closer to the inner edge 24*c* or to the outer edge 24*d*. The reverse arrangement is also possible.

In the embodiment shown, the first tab portion 26*a* has a circumferential length L1 taken in a circumferential direction relative to the axis 11 greater than that of the second tab portion 26*b*. In the depicted embodiment, the first tab portion 26*a* has an axial length L2 taken in an axial direction relative to the axis 11 that is less than that of the second tab portion 26*b*. The tab 26 may be sized correspondingly to the weld process to yield adequate joint strength.

Referring to FIGS. 3-4, the slot 28 may include a first slot portion 28*a* for receiving the first tab portion 26*a*. It may or may not also include a second slot portion 28*b* for receiving the second tab portion 26*b*. The slot portions 28*a* and 28*b* may also be regarded as separate or distinct slots, whether they communicate or not. The circumferential and axial lengths of both the first and second slot portions 28*a*, 28*b* may correspond to those of the first and second tab portions 26*a*, 26*b*. Alternatively, the first and second slot portions 28*a*, 28*b* may be bigger than the first and second tab portions 26*a*, 26*b* to allow for greater weight savings. For instance, and in a particular embodiment, the circumferential length L1 of the first tab portion 26*a* may be less than a circumferential length L3 of the first slot portion 28*a*, which might allow to define a plenum that might otherwise be filled with a material of the body 24.

In the embodiment shown, the first tab portion 26*a* and the first slot portion 28*a* are located closer to the rearward face 24*i* of the body 24 than from the forward face 24*h*. The reverse arrangement may also be considered. If present, the second tab portion 26*b* and the second slot portion 28*b* are located closer to the forward face 24*h* of the body 24 than the rearward face 24*i*. In other words, the second tab and slot portions 26*b*, 28*b* axially overlap the openings 24*e*. That way, the first tab portion 26*a* and the first slot portion 28*a* might not interfere, or intersect, with the openings 24*e* for receiving the vanes 14*c* (FIG. 1). In a particular embodiment, a rear edge 26*c* of the first tab portion 26*a* is axially aligned with the rearward face 24*i* of the body 24.

It is understood that the tab 26 may include only the first tab portion 26*a*. The first tab portion 26*a* may have a greater axial length L2 if the opening 24*e* were more spaced apart from the first and second lateral edges 24*a*, 24*b*. In a particular embodiment, the second tab portion 26*b* in cooperation with the second slot portion 28*b* may stiffen the shroud 20 in comparison to a shroud 20 in which only the first tab and slot portions 26*a*, 28*a* were used.

The body 24 of the shroud segment 22 further defines apertures 24*k*. In the embodiment shown, a number of the apertures 24*k* corresponds to that of the openings 24*e*. These apertures 24*k* may be used for securing a front ring 30 (FIG. 2) that circumferentially extends all around the shroud 20. The front ring 30 may be used to hold the shroud segments round and may include attachment features for a splitter. The front ring 30 may be one of many different interfaces used to secure the shroud 20 to a surrounding case or structure. It is noted that additional fasteners may not be required between adjacent shroud segments 22, as the tab/slot arrangement may provide a structural interconnection between the segments 22. In the embodiment shown, the body 24 of the shroud segment 22 defines a circumferential slot 241 at extending from the forward face 24*h* toward the rearward face 24*i* and that is configured for matingly receiving a portion of the front ring 30. An axial depth of the circumferential slot 241 is greater than an axial distance in the axial direction relative to the axis 11 from the forward face 24*h* to the apertures 24*k* so that the portion of the front ring 30 may be secured to the shroud 20 via, for instance, fasteners (not shown) inserted through the apertures 24*k* of the segment 22 and through registering aperture (not shown) defined through the portion of the front ring 30.

The shroud segment 22, namely its body 24 and tab 26 may be made of polymer material. In a particular embodiment, the polymer material is a polymer composite material. The shroud segments 22 may be manufactured by injection molding, compression molding, thermoforming, or additive manufacturing. Any combination of the above listed manufacturing methods may be used. Other manufacturing methods are contemplated. Having the shroud segments 22 made of a polymer material might allow for a reduction of weight compared to a shroud segment having the same dimensions but made of a metallic material. The tab 26 of the shroud segment 22 might be monolithic with the body 24.

For assembling the shroud 20, each of the shroud segments 22 is disposed circumferentially between two adjacent shroud segments 22. The circumferentially extending tabs 26 are inserted in the corresponding slots 28 of the adjacent shroud segments. The shroud segments 22 are secured to each other.

Securing the shroud segments 22 to each other may include bonding the tabs within the slots, riveting the shroud segments to each other; and/or by thermoplastically welding the shroud segments 22 to each other. The riveting and/or the thermoplastic bonding may be made by riveting and/or thermoplastically bonding the tabs 26 in the slots 28. However, in an embodiment, there is no additional fastener than the mating of tab and slot.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A shroud for a compressor stator, comprising shroud segments circumferentially distributed around an axis of the shroud, at least one of the shroud segments and an adjacent one of the shroud segments each extending from a first lateral edge to a second lateral edge, the at least one of the shroud segments and the adjacent one of the shroud segments each having an inner face oriented toward the axis and an opposed outer face oriented away from the axis, at least one opening extending from the inner face to the outer face for receiving at least one vane of the compressor, a tab protruding circumferentially from the second lateral edge and away from the first lateral edge, and a slot extending circumferentially from the first lateral edge toward the second lateral edge, the at least one of the shroud segments secured to the adjacent one of the shroud segments via the tab of the at least one of the shroud segments matingly received within a slot of the adjacent one of the shroud segments, the tab of the at least one of the shroud segments includes a first tab portion and a second tab portion, a circumferential length of the first tab portion greater than that of the second tab portion, the at least one opening of the adjacent one of the shroud segments includes a plurality of openings, the first tab portion circumferentially overlapping at least one of the plurality of the openings.

2. The shroud of claim 1, wherein an axial length of the first tab portion relative to the axis is less than that of the first lateral edge.

3. The shroud of claim 1, wherein the at least one of the shroud segments includes a forward edge and a rearward edge opposite the forward edge, the forward and rearward edges extending from the first lateral edge to the second lateral edge, the first tab portion located closer to the rearward edge than to the forward edge.

4. The shroud of claim 1, wherein a rear edge of the tab is axially aligned with a rearward edge of the at least one of the shroud segments.

5. The shroud of claim 1, wherein the second tab portion axially extends relative to the axis from the first tab portion.

6. The shroud of claim 1, wherein the second tab portion axially overlaps the at least one opening of the adjacent one of the shroud segments.

7. The shroud of claim 1, wherein the at least one of the shroud segments is made of a polymer composite material.

8. The shroud of claim 1, wherein the at least one opening is circumferentially surrounded by an abutment surface and by a peripheral surface, the peripheral surface extending from the outer surface toward the inner surface, the abutment surface extending from the peripheral surface to the at least one opening, the peripheral surface and the abutment surface bounding a volume sized for receiving a platform of the at least one vane.

9. The shroud of claim 1, wherein the at least one of the shroud segments includes a forward edge and a rearward edge opposite the forward edge, the forward and rearward edges extending from the first lateral edge to the second lateral edge, the at least one opening located closer to the forward edge than the rearward edge.

10. A shroud segment for a shroud of a compressor stator having an axis, comprising: a body made of a polymer composite material, the body having a first lateral edge and a second lateral edge, the body extending circumferentially relative to the axis from the first lateral edge to the second lateral edge, an inner face oriented toward the axis and an opposed outer face oriented away from the axis, at least one opening extending from the inner face to the outer face for receiving at least one vane of the compressor, a tab protruding circumferentially from the second lateral edge and away from the first lateral edge, and a slot extending circumferentially from the first lateral edge toward the second lateral edge, the tab configured to be matingly received within a slot of a circumferentially adjacent shroud segment, the slot configured to receive a tab of another circumferentially adjacent shroud segment, the tab of the other circumferentially adjacent shroud segment thermoplastically welded in the slot.

11. The shroud segment of claim 10, wherein the tab of the other circumferentially adjacent shroud segment includes a first tab portion and second tab portion, a circumferential length of the first tab portion greater than that of the second tab portion.

12. The shroud segment of claim 11, wherein an axial length of the first tab portion relative to the axis is less than that of the first lateral edge.

13. The shroud segment of claim 11, wherein the shroud segment include a forward edge and a rearward edge opposite the forward edge, the forward and rearward edges extending from the first lateral edge to the second lateral edge, the first tab portion located closer to the rearward edge than to the forward edge.

14. The shroud segment of claim 11, wherein the slot has a first slot portion and a second slot portion sized to receive the first tab portion and the second tab portion of another shroud segment, the at least one opening including a plurality of openings, the first slot portion circumferentially overlapping at least one of the plurality of the openings.

15. The shroud segment of claim 10, wherein the shroud segment includes a forward edge and a rearward edge opposite the forward edge, the forward and rearward edges extending from the first lateral edge to the second lateral edge, the at least one opening located closer to the forward edge than the rearward edge.

16. A method of assembling a shroud for a compressor, the shroud including a plurality of shroud segments, the method comprising:

disposing each of the shroud segments circumferentially between two adjacent shroud segments relative to an axis of the shroud;

inserting a circumferentially extending tab of a first shroud segment of the plurality of shroud segments in a corresponding slot defined in a second shroud segment of the plurality of shroud segments adjacent the first shroud segment; and securing the first shroud segment to each other the second shroud segment by welding the tab within the slot.

17. The method of claim 16, wherein the shroud segments are made of a composite polymer material, the welding of the tab within the slot includes thermoplastically welding the tab within the slot.

18. The method of claim 16, wherein the inserting of the circumferentially extending tab into the corresponding slot includes inserting the circumferentially extending tab into the corresponding slot until the circumferentially extending tab circumferentially overlaps at least one of a plurality of openings defined through the second shroud segment and sized for receiving vanes.

* * * * *